US008474919B2

(12) United States Patent
Cipriani et al.

(10) Patent No.: US 8,474,919 B2
(45) Date of Patent: Jul. 2, 2013

(54) ROAD MILLING MACHINE WITH REPLACEABLE MILLING DRUM WITH DIFFERENT CUTTING WIDTHS

(75) Inventors: Antonio Cipriani, Alfonsine (IT); Enio Cavallini, Alfonsine (IT)

(73) Assignee: Marini S.p.A. (IT)

( * ) Notice: Subject to any disclaimer, the term of this patent is extended or adjusted under 35 U.S.C. 154(b) by 88 days.

(21) Appl. No.: 12/987,455

(22) Filed: Jan. 10, 2011

(65) Prior Publication Data

US 2011/0163589 A1 Jul. 7, 2011

Related U.S. Application Data

(63) Continuation of application No. PCT/EP2008/005598, filed on Jul. 9, 2008.

(51) Int. Cl.
*E01C 23/088* (2006.01)

(52) U.S. Cl.
USPC ..... 299/39.4

(58) Field of Classification Search
USPC ..... 299/39.1, 39.2, 39.4; 404/90, 93, 404/94
See application file for complete search history.

(56) References Cited

U.S. PATENT DOCUMENTS

| | | | | |
|---|---|---|---|---|
| 5,505,598 | A * | 4/1996 | Murray | 404/90 |
| 5,722,789 | A | 3/1998 | Murray et al. | |
| 6,877,818 | B1 * | 4/2005 | Gaertner et al. | 299/39.8 |

FOREIGN PATENT DOCUMENTS

| | | | |
|---|---|---|---|
| DE | 102004025567 | A1 | 10/2005 |
| EP | 0694651 | A2 | 1/1996 |
| EP | 1197601 | A2 | 4/2002 |
| EP | 1194651 | B1 | 8/2002 |
| EP | 1520076 | B1 | 1/2006 |

OTHER PUBLICATIONS

International Preliminary Report on Patentability; PCT/EP2008/005598; Nov. 18, 2010; 34 pages.
International Search Report; PCT/EP2008/005598; Mar. 17, 2009; 3 pages.

* cited by examiner

*Primary Examiner* — Sunil Singh
(74) *Attorney, Agent, or Firm* — St. Onge Steward Johnston & Reens LLC

(57) ABSTRACT

Self-propelled road milling machine with a milling drum housing including a side with a power take-off to transmit rotational motion to a milling drum mounted in an axially sliding way and replaceable from the side opposite the side of the power take-off. The milling drum is rotated by a reduction gear. The reduction gear is mounted at the end of a hollow spacer. A transmission shaft is present in the hollow spacer. The hollow spacer connects the wall of the housing on the side of the power take-off to a support flange of the reduction gear, which is connected to a spacer. The spacer engages a movable flange of the reduction gear, and connects to fastening elements and the support on the wall of the housing. The support flange and the hollow spacer are static with respect to the rotary movement of the milling drum.

22 Claims, 8 Drawing Sheets

ROAD MILLING MACHINE WITH REPLACEABLE MILLING DRUM WITH DIFFERENT CUTTING WIDTHS

CROSS-REFERENCE TO RELATED APPLICATIONS

The present application is a continuation of pending International patent application PCT/EP2008/005598 filed on Jul. 9, 2008 which designates the United States and the content of which is incorporated herein by reference.

FIELD OF THE INVENTION

The present invention concerns a milling machine with variable width milling drum and in particular a milling machine for asphalt, concrete and other materials used for road pavings.

BACKGROUND OF THE INVENTION

A road milling machine is a self-propelled machine, of known technology, finalized to the demolition of road pavements by means of milling with rotating milling drum. The road milling machines generally are equipped with fixed width milling drums contained in a housing opened downwardly to ensure the contact of said milling drum with the surface to mill and opened frontally for the flow of the milled material outside of the milling drum housing. To change the milling width it is necessary to replace not only the milling drum, but also a series of equipments dependent from the sizes of the milling drum itself.

Solutions concerning milling drums modifiable with different cutting widths are also known, which solutions however generally involve difficulties in the assembling or modification and long set-up times.

EP0694651 discloses an improvement of a cold road milling machine having means for the advancement of the machine and a milling drum mounted on the machine for cutting a certain material width along the path of the machine and a conveyor mechanism for transporting the milled material generated by the cut of the milling drum away from the machine, the improvement including:

a. a rotating milling drum divided into two or more sections with at least one of said sections being divided into segments.
b. means for the assembly of said segments on said milling drum whereby when said segments are mounted to said milling drum, the width of cut of the milling drum is increased, and when said segments are removed from said milling drum, the width of cut is decreased;
c. a drive train for providing power to rotate said milling drum;
d. said drive train having a power input end and a power output end;
e. a first section of the milling drum being connected at the power output of the transmission train and substantially flush mounted with reference to the drum end opposite to the power input of the entry of power of the drive train, and one or more additional segmented sections.
f. means to connect the segments of said additional sections to said first section of the drum, where said additional segmented sections are mounted between the first section of the drum and the power input of the drive train.
g. a planetary gear device that transmits the power output to the milling drum, a transmission shaft that comes through the milling drum and connected to the planetary gear, milling means surrounding said planetary gear.

U.S. Pat. No. 5,722,789 discloses an improvement of a cold road milling machine, said machine including a drive train having an end for the intake of the power at one side of the machine and an end for the delivering of the power on the other side of the machine, said intake end of the power of said drive train being connected to a power source. Said delivering end of the power of said drive train connected to a reduction gear mounted within an appropriate housing, said housing of the reduction gear having opposite ends, an end of said housing of the reduction gear being generally flush mounted on the side of the machine corresponding to the power delivering side, said housing of the reduction gear being mounted for the rotation, in relation to said machine, of a cylinder that extends from the opposite end of said housing of the reduction gear towards the other side of said machine, means to command the rotation of said cylinder, said improvement including:

a. a set of milling drums, each drum in said set of milling drums having opposing ends and being of a different length
b. each drum in said set of milling drums being divided into segments
c. means for releasably connecting one end of any selected one drum of said set of milling drums to said one end of said housing of the reduction gear
d. a connector element on the other end of at least one of said drums in said set of milling drums whereby said at least one of said drums can be releasably connected at its other end to said drum EP1520076 discloses a self-propelled road milling machine comprising a machine chassis, inside of which a milling drum is mounted in such a way to be rotary between side-walls which are orthogonal to the axis of the milling drum, the milling drum, which has a drum base body and a milling pipe, being suitable to be commanded by means of control means that are supported on the exterior of the side-wall on the power intake side and by means of a reduction gear, and the side-wall situated on the opposite side relative to the side-wall on the power intake side, this being easily demountable for changing alternative milling drums, having different milling widths, and defining the zero-side of the machine against which a face of the milling drum is in abutment in an approximately flush way to allow the milling in proximity to a border, characterised in that:

a. the reduction gear is mounted on the intake side of the transmission
b. the reduction gear includes on the exit a transmission element, which is mounted on the inside of the side-wall on the input side of the transmission and whose external surface forms a seat for elements of the milling drum which may be slided on it starting from the zero-side
c. the drum base body is coupled to the reduction gear at the exit free frontal face of the transmission without opposing to the sliding of the elements of the milling drum.

EP1194651 discloses a milling drum comprising a drum base body driven by a milling drum drive device via a transmission unit, a one-piece tubular milling drum coaxially slidably mounted from one side on the drum base body in a manner allowing exchange thereof, the milling drum carrying cutting tools on the outer surface, the milling drum includes fastening elements radially projecting from an inner surface of the milling drum by which the milling drum can be secured in a rotationally fixed manner to the drum base body, said milling drum drive device being placed in correspondence of a side of said drum base body opposite to said side, said fastening means being provided on at least one side of said milling drum, said milling drum being connected to a side-wall of said drum base body and being radially supported on the other side, said fastening means being connected to the base body including the transmission unit integrated on it, said transmission unit being mounted at the end of the base body with the exit directed towards the control group, the input being controlled by a transmission shaft passing through the base body, said base body being supported by two side-walls of the milling drum housing, said housing being provided with an opening that allows the access to the fixing elements between the milling drum and the control group without dismounting parts of the machine.

DE 10 2004 025567 discloses a device for removing a road surface comprising a chassis, a cutting roller (11), and a cutting roller drive with a transmission. The cutting roller can be exchangeably mounted between the side walls (20) of a cutting roller box and is rotationally driven by the cutting roller drive via the transmission. The cutting roller can be exchanged together with at least one part of one side wall and optionally the transmission as one unit.

EP0694651 though allowing a simplified variation of the milling width of the machine that does not require any replacement of parts related to the transmission, however requires the carrying out of different operations in the changing phase of the milling width, as the milling drum results subdivided into two or more sections, each of the sections able to make the variation of the milling width being divided in segments, each of which, in the illustrated embodiment, covers an arc of 120 degrees. When said sections are not utilized, that is one operates with a reduced milling width, for each of them it is necessary to mount in their respective places a rotating blades wheel suitable to push the milled material toward the collecting belt for facilitating its removal from the inside of the milling drum housing. Said blades wheel is also divided into a number of segments corresponding to the number of segments forming the additional sections of the milling drum and, therefore, in the shown embodiment, three segments each of which covering an arc of 120 degrees. Both the segments of the rotating blades and the segments of the additional sections of the milling drum are screwed by means of bolts on radial protrusions of the transmission shaft. Said bolts are therefore exposed to the milled material, and for this reason at the moment of the change of the milling width it will be necessary to clean the rotating blades and/or the sections of the milling drum to be replaced in order to have access to said bolts, remove all of the bolts of each segment of each section whereon one must intervene, remove the blade segments to replace them with the segments of the milling drum or vice-versa, and screw again the bolts. Said operation requires however a long intervention time because of the need to operate on more then one segment, the intervention times being possibly further increased because of the wear and tear of the bolts caused by the milled material. Moreover the replacement operation of the milling elements occurs accessing the milling drum housing from the back, obliging the operator to work in a narrow space and in uncomfortable working positions. The illustrated preferred embodiment, moreover, provides that the first section, the one defining the minimum milling width, is made in a single piece coaxial to the reduction gear, so that if it is necessary to replace said first section for wearing or damage, it is anyway required the dismounting of the reduction gear itself, with consequent considerable lengthening of the intervention time. Moreover the first milling section, being always in use even in the case of greater milling widths, results subject to a greater wearing compared with the added sections, compromising the quality of the milling itself and requiring a more frequent replacement of the tools of said first section compared with the others. A big problem in this solution is also that when one is working with a milling drum with reduced size compared with the maximum admissible width, the part of the transmission not including the milling sections is rotating inside the milling drum housing containing the milled material, said rotation therefore occurring in the presence of the bituminous milled material that in this way is continuously kneaded contributing to the constitution of agglomerations adhering to said part of transmission and hardly removable. Said rotating action causes also a consisting friction with the milled material present in the milling drum housing that beside worsening the kneading of the material itself, causes a power loss and an early wearing, requiring the presence of replaceable protective elements. Not less important is the presence of a reduction gear different with respect to reduction gears commonly commercially available, because, being said reduction gear mounted at the right-hand side of the machine and symmetrically with respect to the design of the reduction gear mounted at the left-hand side of the machine, it is necessary to use a reduction gear with passing-through hollow input shaft. This entails the following problems:

- additional cost due to the need to design a specific reduction gear for this application
- additional cost due to the lower number of reduction gears built because they are hardly utilizable in other contexts, where the reduction gears configured with the entry of the transmission shaft according to the conventional design instead find application
- problems in supplying spare parts because they are reduction gears of a special embodiment that would therefore require a specific warehouse stock in lower quantities if compared with the stocks of the conventional reduction gears.

U.S. Pat. No. 5,722,789 presents an embodiment similar to the previous one in which all the sections, including the first one, are subdivided into two opposite segments each of which covering an arc of 180 degrees, rather than three segments, said segments being reciprocally fixed and not on radial protrusions of the transmission shaft. For this reason the transmission of the power to said sections occurs by means of a couple of opposite keys each of them transmitting the motion to the respective corresponding section. These keys are screwed in suitable seats present on the supporting rotating cylinder and are housed in different positions depending on the milling width to be adopted. This solution, though reducing the number of parts to be replaced for each section, requires also the moving of the keys transmitting the motion to said sections, therefore involving anyway a high number of pieces to be replaced. Moreover said solution anyway involves the need to operate on different segments and it also results affected by the problem of the inaccessibility of the fixing bolts both of the keys and of the segment themselves, said bolts being exposed directly to the milled material and therefore requiring a preliminary cleaning operation in order to be able to have access and intervene on them. Moreover the replacement operation of the milling elements occurs accessing the milling drum housing from the back, obliging the operator to work in a narrow space and in uncomfortable working positions. Moreover the first milling section, being always in use, even in the case of greater milling widths, results subject to a greater wearing compared with the added sections, compromising the quality of the milling itself and requiring a more frequent replacement of the tools of said first section compared with the others. Also in this case the problem remains for which when one is working with a milling drum with reduced size compared with the maximum admissible width, the part of the transmission not including the milling sections is rotating inside the milling drum housing containing the milled material, said rotation therefore occurring in the presence of the bituminous milled material that in this way is continuously kneaded contributing to the constitution of agglomerations adhering to said part of transmission and hardly removable. Said rotating action causes also a noteworthy friction with the milled material present in the milling drum housing that beside worsening the kneading of the material itself, causes a power loss and an early wearing, requiring the presence of replaceable protective elements. Also in this case it is necessary the presence of a reduction gear different with respect to reduction gears commonly commercially available, said reduction gear being mounted at the right-hand side of the machine and symmetrically with respect to the usual design, this involving the inversion of the entry of the transmission shaft, that also in this case occurs from the left-hand side of the machine. This entails the aforementioned problems deriving by the additional costs for the need to a specific design of the reduction gear, for the lower number of pieces produced and also deriving by the supplying problems of spare part with respect to conventional reduction gears.

EP1520076 though solving some of the abovementioned problems about the previous solutions, as soon as it uses different milling drums with overall length corresponding to the desired cutting width which can be sideways removed with reference to the machine, has other disadvantages about the positioning of the reduction gear, that is mounted on the left-hand side of the machine involving the presence of an element of transmission able to ensure the possibility to insert the lower width milling drums in such a way that they are flush with the right side of the machine, said element of transmission constituting an additional rotating mass with consistent size. Also in this case the problem remains for which when one is working with a milling drum with reduced size compared with the maximum admissible width, the part of the transmission not including the milling sections, that in this case is the casing of the reduction gear covered with the corresponding protection tube, is rotating inside the milling drum housing containing the milled material, said rotation therefore occurring in the presence of the bituminous milled material that in this way is continuously kneaded contributing to the constitution of agglomerations adhering to said part of transmission and hardly removable. Said rotating action causes also a noteworthy friction with the milled material present in the milling drum housing that beside worsening the kneading effect of the material itself, causes a power loss and an early wearing, requiring the presence of replaceable protective elements.

EP1194651 though solving some of the abovementioned problems about the previous solutions, as soon as it uses different milling drums with overall length corresponding to the desired cutting width which can be sideways removed with reference to the machine, and though having the reduction gear unit mounted on the right side of the machine, has other disadvantages from the point of view of the fixing of the milling drum. In fact, for milling drums with greater width, apart from the fixing point on such element of transmission integral with the reduction gear, an additional support is necessary that in the case of the disclosed invention is realized at the external surface of the base body of the drum itself by means of a movable radial support ring. Said radial support ring can be shifted in various positions depending on appropriate seats realized on the external part of the base body of the drum. If one works with milling drums with lower widths, the seats that are not utilized must be protected from the exposure to the milled material in order to avoid the clogging by means of appropriate protection plates fixed on the seats by means of screws, these screws themselves therefore being exposed to the milled material and subject to clogging due to the same, which lengthens the replacement time of the milling drum when said annular support and said protection plates must be shifted. Also in this case the problem remains for which when one is working with a milling drum with reduced size compared with the maximum admissible width, the part of the transmission not including the milling sections is rotating inside the milling drum housing containing the milled material, said rotation therefore occurring in the presence of the bituminous milled material that in this way is continuously kneaded contributing to the constitution of agglomerations adhering to said part of transmission and hardly removable. Said rotating action causes also a noteworthy friction with the milled material present in the milling drum housing that beside worsening the kneading effect of the material itself, causes a power loss and an early wearing, requiring the presence of replaceable protective elements. Also in this case it is necessary the presence of a reduction gear different with respect to reduction gears commonly commercially available, said reduction gear being mounted at the right-hand side of the machine and symmetrically with respect to the usual design, this involving the inversion of the entry of the transmission shaft, that also in this case occurs from the left-hand side of the machine. This entails the aforementioned problems deriving by the additional costs for the need to a specific design of the reduction gear, for the lower number of pieces produced and also deriving by the supplying problems of spare part with respect to conventional reduction gears.

Therefore, all of the prior art systems, have in common the characteristic that, when milling drums with lower width are mounted, they have at least one part of the transmission system exposed to the milled material present in the case said part being rotating in an integral way together with the milling drum itself. More negative effects are the power loss and the early wearing of the rotating parts dipped in the milled material.

The invention has the following aims:

- replace a milling drum of a certain cutting width with a different width drum, without replacing other parts and making this operation fast and easy also for unskilled personal.
- replace a milling drum of a certain cutting width with a different or same width drum, but with different spacing of the tools, without replacing other parts and making this operation fast and easy also for unskilled personal.
- not penalize the milling depth with respect to the one obtainable with the milling drum with maximum width.
- allow the milling "flush to the wall" on the right side of the machine for any width of the milling drum
- allow the use of commercially available reduction gears avoiding to recur to reduction gears specifically designed for the application on the machine object of the present invention.

SUMMARY OF THE INVENTION

The proposed solution according to the present invention presents advantages from the point of view of the handiness in the replacement of the milling drum for which a uniform wearing along its whole length is advantageously guaranteed contrarily to the systems of the prior art that provide milling drums divided into individually disassemblable sections.

Moreover the exposure to the milled material of the elements on which the operator must intervene during the operations of replacement of the milling drum is advantageously avoided.

The presence of the rotating transmission elements is also advantageously eliminated in the part of the milling cutter case not involved by the milling drum when milling drums with lower width are utilized, in this way avoiding the kneading effect of the bituminous milled material accumulating in it as well as the presence of frictions between it and the transmission parts causing their heating and wears.

BRIEF DESCRIPTION OF THE DRAWINGS

An embodiment of the invention is now described, by way of example only, with reference to the accompanying drawings in which.

DETAILED DESCRIPTION OF THE INVENTION

Figure 1:
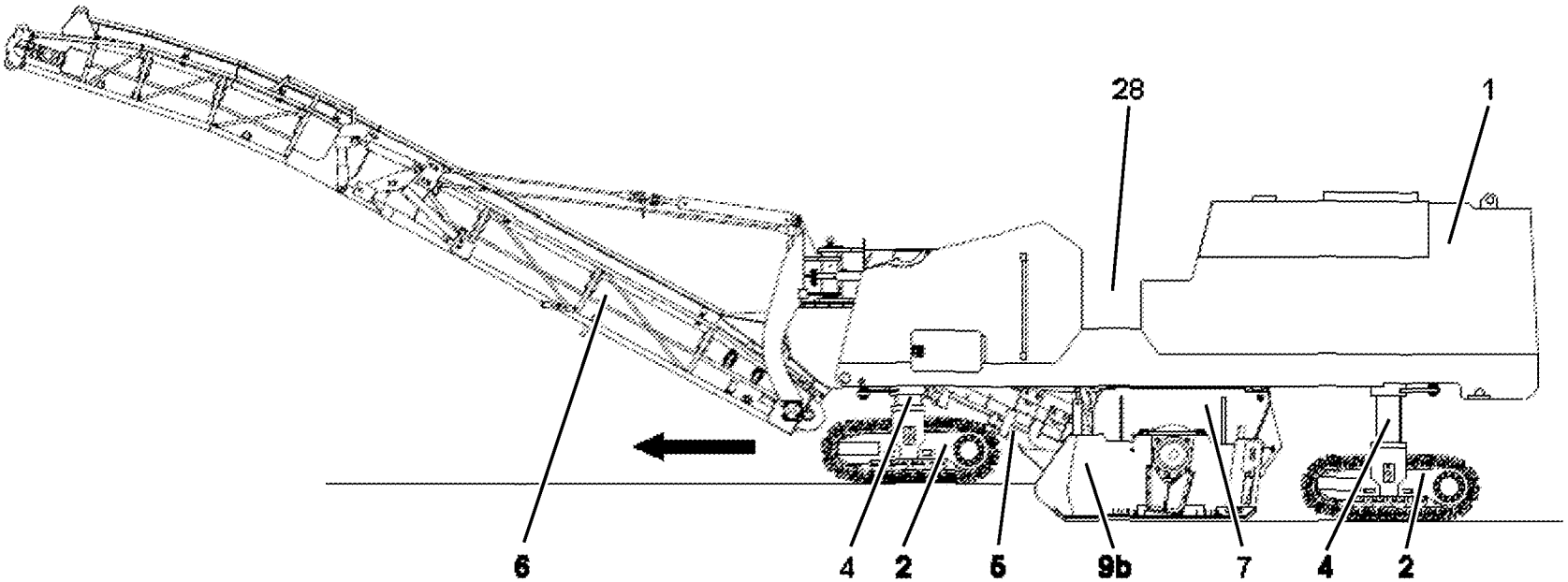
FIG. 1 represents a side view of a milling machine.
Figure 2:
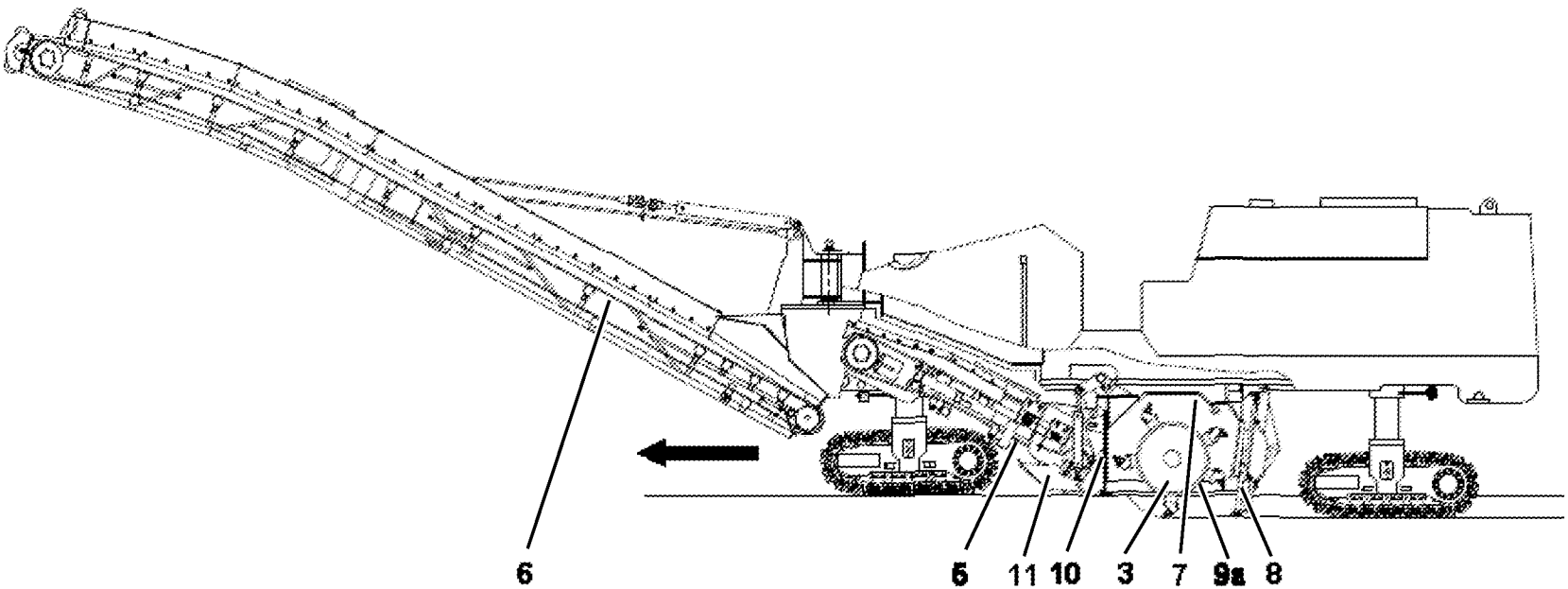
FIG. 2 represents a side view of the milling machine of FIG. 1, partially in section to show some of the internal components.

Because of the wearing of the pavement due to atmospheric causes apart from the continuous passage of vehicles, the periodical renewal of the same is necessary. For such renewal operation the removal of the old pavement is generally required or at least the removal of its upper layer to avoid the creation of dangerous steps due to the laying of the new pavement at the connection points with parts of pavement previously applied and still in good conditions. In some cases the removal of the pavement is absolutely necessary as in the case of bridges, for which the removal of the old pavement must be carried out before the laying of the new pavement in order to avoid the increasing of the weight held up by the bridge itself and due to the subsequent repaving one following the other in the course of time, or in the case of railway crossings with reference to which the same height of the pavement must be held in order to avoid dangerous steps that would compromise the grip of the vehicles. The milling machines answer to this need, being machines specially conceived for the removal of the old pavement before the laying of the new material. The road milling machine (FIGS. 1, 2) consists of a self-propelled chassis (1) supported on tracks (2), or wheels, generally equipped with hydraulic drives that pull power from a diesel engine. The milling drum (3) is supported by the chassis (1), transversely to the advancement direction of the machine and is activated by the diesel engine through a mechanical transmission, or by a hydraulic transmission. The tracks (2), or wheels, are connected to telescopic columns (4), by means of which the chassis (1) is brought to height and set to obtain the correct milling profile. The material milled by the milling drum (3) is removed by a system of one or two conveyor belts (5, 6) and it can be discharged at the forepart or at the rear part of the machine. In the first case the material is discharged on means of transportation that precedes the milling machine, while in the second case the means of transportation follows the milling machine proceeding in reverse motion.

The description of the invention refers to its application on a road milling machine with frontal discharge of known technology (FIGS. 1, 2), in which the milling drum (3) is housed in a milling drum housing (7). Referring to the advancement direction during operation, the milling drum housing (7) is provided with a movable rear mouldboard (8), provided with scraper tools for cleaning of the milled surface, and is provided with two movable side plates (9*a*, 9*b*) in contact with the road surface, with floating action or slightly forced downwards. However, it will apparent to one skilled in the art that the invention object of the present application is applicable also to milling machines with rear discharge.

In the forepart of the milling drum housing (7) an opening (10) is present, which allows the discharge of the milled material onto a first conveyor belt (5), generally identified as collecting belt. Said collecting belt (5) has its rear part supported by a device commonly known with the name of "pressure bar" (11), generally kept in more or less forced contact with the surface to mill, and the forepart sliding on a support connected to the chassis (1) of the machine.

The rear mouldboard (8) can be vertically moved and can rotate around a horizontal axis. The vertical movement allows to maintain the mouldboard in contact with the milled surface with a floating, or forced, action but for particular operative needs the mouldboard may also be held partially raised to leave the material flow below it. Its lower edge is provided with scraper tools for cleaning the milled surface. The rotatory motion around a hinge with horizontal axis allows the opening of the mouldboard to access the tools of the milling drum (3) for maintenance operations or for its inspection.

Figure 3:
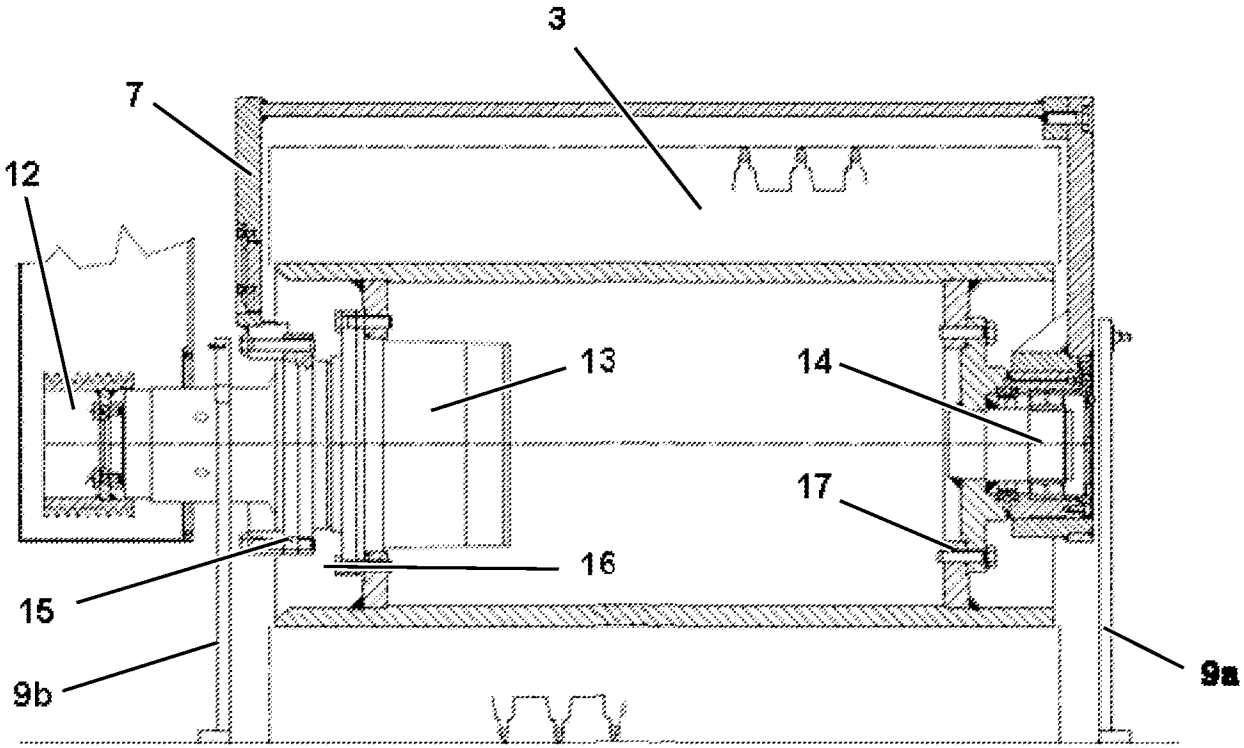
FIG. 3 represents a sectional view of a typical system supporting the milling drum according to the prior art.

A typical system of the prior art for supporting the milling drum and for the transmission of its rotatory motion around an axis perpendicular to the advancement direction of the machine (FIG. 3) is provided with a pulley (12), placed on the left-hand side of the machine, which receives the motion from the diesel engine through a clutch and a trapezoidal belts transmission. The pulley (12) is keyed on the input shaft of the reduction gear (13), constrained to the milling drum housing (7) by the fixing flange (15) of the reduction gear on the milling drum housing and engaged with the frame of the milling drum (3) by the flange (16). The reduction gear (13) therefore constitutes the support of the milling drum (3) on the left-hand side of the machine. On the right side the milling drum (3) is supported by the milling drum housing (7) by means of the support (14), engaged with the frame of the milling drum by means of the flange (17). Said reduction gear (13) is necessary to convert the rotation with high number of revolutions per minute given by the engine into a rotation of the drum having the required torque for milling the road surface.

The road milling machines are generally equipped with fixed width milling drums. To change the milling width it is necessary to replace not only the milling drum but also a series of equipments depending on the sizes of the drum itself. Solutions concerning milling drums modifiable with different cutting widths are also known, which solutions however generally involve difficulties in the assembling or modification and long set-up times as previously disclosed.

Figure 4:
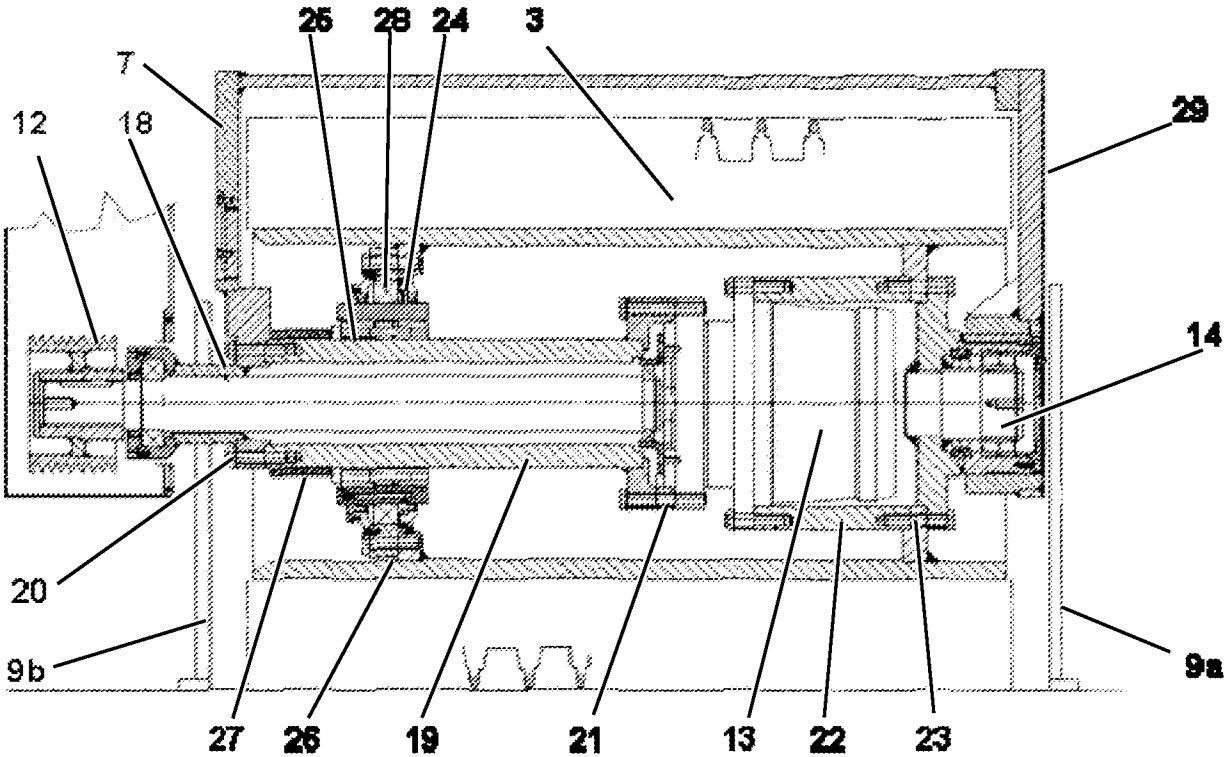
FIG. 4 represents a sectional view of the system supporting the milling drum according to the present invention with the milling drum having the maximum width.
Figure 5:
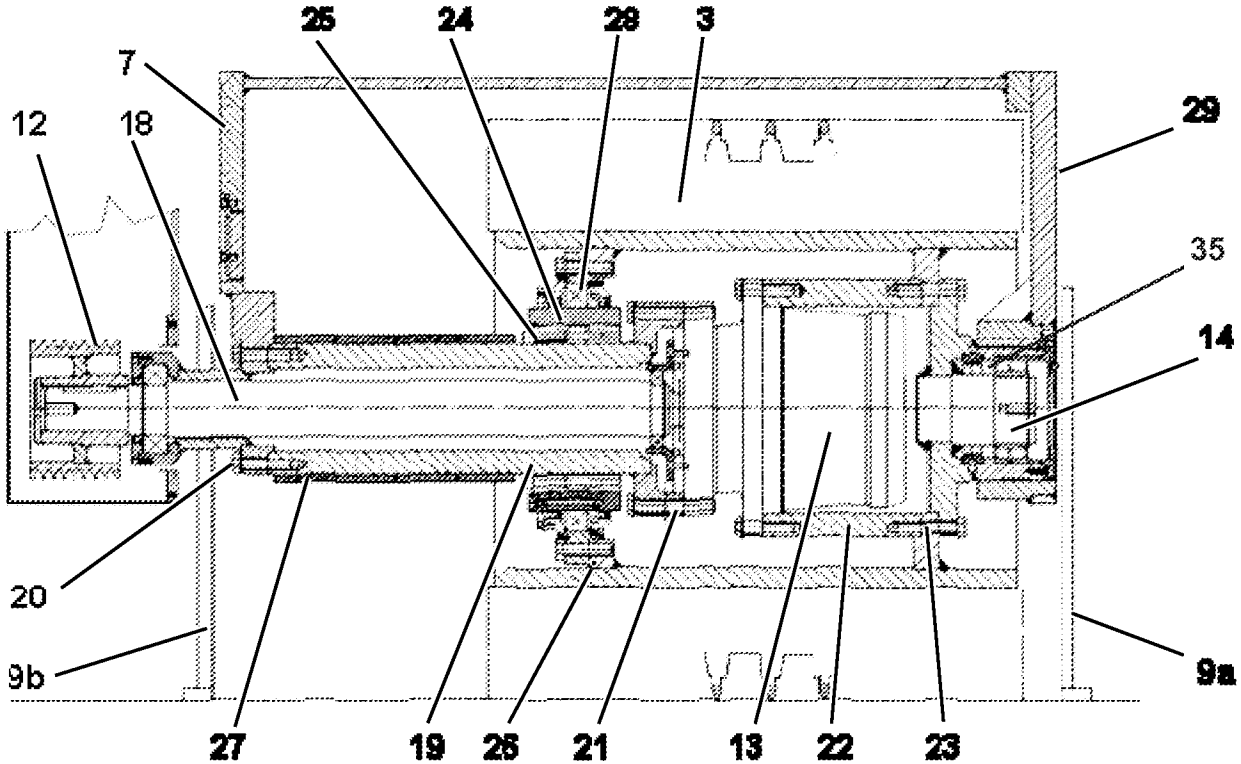
FIG. 5 represents a sectional view of the system supporting the milling drum according to the present invention with a intermediate width milling drum.

In the solution object of the invention (FIG. 4), the reduction gear (13) is advantageously fitted on the right side of the machine, in order to allow a fast and simple installations of milling drums even with relatively small width, but able to cover the overall dimensions of the reduction gear. In fact, in the case of the mounting of milling drums with reduced width, they must necessarily be mounted at the right side of the machine because it is generally necessary to perform millings flush to the right side, because the presence of obstacles as guard-rails, platforms, etc. precludes the machine to move beyond the limit imposed by such obstacles and the milling flush to them would be impossible if the milling drum with lower width is mounted at a position even a little sideways re-entered with respect to the right-hand edge of the machine.

The eventual protrusion of the overall dimensions of the reduction gear beyond the left-hand flush of the milling drum would constitute a limit for the milling depth, because said projection of the reduction gear could interfere with the road surface.

The shaft (18) transfers the motion from the pulley (12) to the reduction gear (13) that in the preferred embodiment is a planetary reduction gear.

Advantageously and in a different way with respect to prior art techniques the reduction gear unit (13) is a reduction gear commercially available, the adopted solution not requiring, therefore, the design and the realization of a reduction gear specifically designed for the application on the milling machine. This entails a reduction of the cost of the reduction gear both because it does not require any specific design activity and because the production of standard reduction gears is greater if compared with the production of specifically designed reduction gears. Moreover also the management of relative spare parts is simplified, not requiring a management separated from the standard production of conventional reduction gears.

Advantageously and in a different way with respect to prior art techniques, the flange (21) of the reduction gear (13) is rigidly connected by means of the left-hand spacer (19) to the fixing flange (20) of the spacer on the left wall of the milling drum housing (7), that therefore constitutes the reaction constraint. The reduction gear (13) instead is connected on the opposite side to the support (14) by means of the right-hand spacer (22) and the right flange (23) of the frame of the milling drum (3). It will result evident that the left-hand spacer (19) and the flange (21) of the reduction gear are static elements, namely no rotational motion is transmitted to them, so that said solution solves the problem of prior art techniques, problem for which, when one is working with a milling drum with reduced size compared with the maximum admissible width, the part of the transmission not including the milling sections is rotating inside the milling drum housing containing the milled material, said rotation therefore occurring in the presence of the bituminous milled material that in this way is continuously kneaded contributing to the constitution of agglomerations adhering to said part of transmission and hardly removable, said rotation action causing also a noteworthy friction with the milled material present in the milling drum housing that beside worsening the kneading effect of the material itself, causes also a overheating of said transmission part and its early wearing, requiring the presence of replaceable protective elements.

In the solution object of the present invention, instead, the only element put in rotation by the reduction gear (13), of course apart from the milling drum (3) with the corresponding right flange (23) and left flange (26), is the right-hand spacer (22), this also involving an advantageous reduction of the rotating masses present inside the milling drum housing (7) with consequent reduction of the possible problems of loss of balancing of the rotating masses themselves, said loss of balancing involving the insurgence of further vibrations causing early wearing in the systems for the connection and support of the rotating group consisting of the shaft (18), the reduction gear (13), the milling drum (3) and the right-hand spacer (22).

Figure 8:
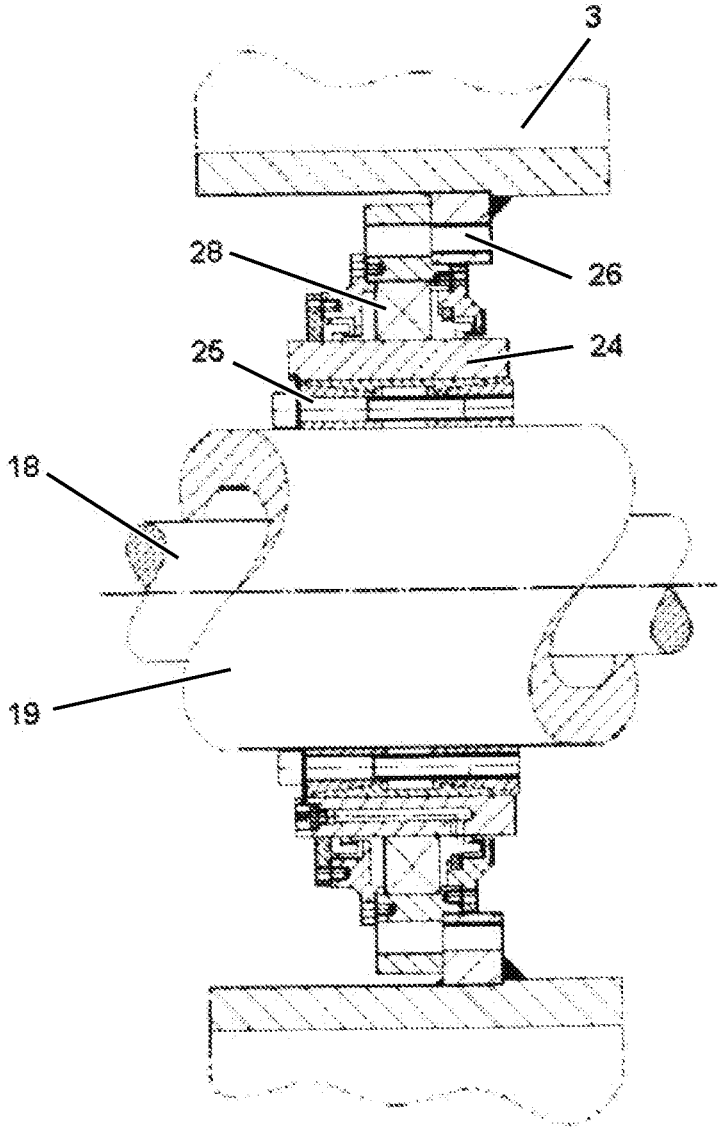
FIG. 8 represents a sectional view of the support of the milling drum present on the left-hand side of the same.

Also in this case, anyway, it is necessary the presence of a support for the milling drum on the left-hand side of the same. The prior art techniques provide that said support on the left-hand side of the milling drum (3) is stationary and, therefore, integral with the milling drum itself. This not only implies that said support must rotate together with the milling drum (3) but also implies that the base itself, whereon said support is fixed, must be rotating, this implying on its part the need of the rotation of the spacer for the mounting of the reduction gear with the previously exposed problems. In the solution object of the present invention, said support (FIG. 8) laying on the left-hand spacer (19) near the left-hand side of the milling drum (3) is made by means of the ring (24), said ring being connected to the milling drum (3) at the left flange (26) of the frame of the milling drum (3) itself by a bearing (28), said ring (24) being connected to the left-hand spacer (19) by a self-centering cone clamping (25). The support of the milling drum present on the left-hand side of the same is thus consisting of a rotating part integral with the left flange (26) of the frame of the milling drum and of a fixed part (24, 25) integral with the left-hand spacer (19), between the two parts being interposed said bearing (28). This system allows the free rotation of the milling drum (3) and of the part of the support integral with the milling drum itself with respect to the other part of the support that thus results fixed and integral with the left-hand spacer (19). Said solution, in combination with the presence of the fixed left-hand spacer (19), contributes to obtain the fundamental result not to have rotating movable parts within the milled material that accumulates in the free part of the milling drum housing (7) solving the consequent problems previously explained. The axial centring of the milling drum (3) during the assembly is assured by means of the self-centering clamping (25).

Advantageously said system therefore integrates two functions:

- to free the rotation of the left-hand support of the milling drum with respect to left-hand spacer (19) that can therefore be fixed
- ensure the axial centring of the milling drum (3)

Figure 6:
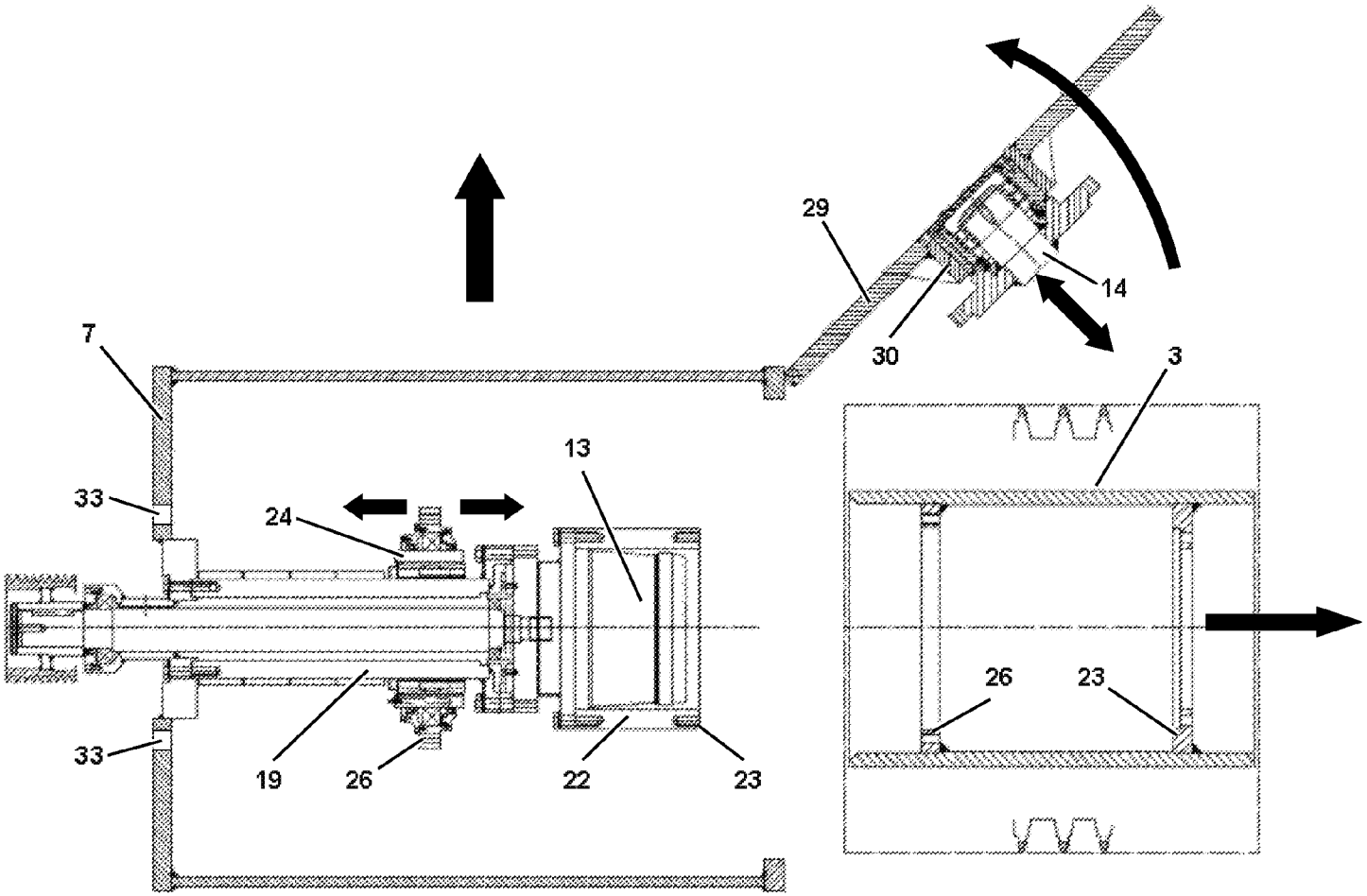
FIG. 6 represents a sectional view of the system supporting the milling drum according to the present invention showing the removing operation of the milling drum.

Though said fixing system can appear more expensive with respect to more simple securing arrangements used in the machines of the prior art, it should be noticed that said cost is advantageously annulled by the reduced cost of the reduction gear that, as previously explained, unlike the machines of the prior art, is a reduction gear commercially available and not a reduction gear specifically designed and built-up. Moreover said fixing system with ring (24), bearing (28) and self-centering clamping (25) presents tolerances sufficiently strict for ensuring the reciprocal connection of components, but sufficiently large to allow a free sliding of the fixing system on the whole that advantageously results sliding on the external surface of the left-hand spacer (19), as schematically represented by the arrows in FIG. 6, so that the adjusting operation of the longitudinal position of said support system depending on the width of the used milling drum (3) results particularly simple. Said adjusting operation of the longitudinal position of said support system can be performed in a particularly simple way, for instance by means of the recourse to a spacer-tool that allows the movement till the reaching of the desired position with respect to the reduction gear (13), said spacer-tool being able, by way of example only, to be temporarily fixed on the flange (23) of the reduction gear (22) until the adjustment is completed.

The system can comprise also a series of segmented shells (27) able to protect the left-hand spacer (19) from the abrasion exercised by the pushing action of the milled material, said abrasion being anyway reduced with respect to prior art systems because said left-hand spacer (19) is fixed and not rotating inside the milled material that accumulates within the milling drum housing (7) when milling drums (3) with reduced width are used. Said segmented shells (27) can be realized in the form of half-hulls or in the form of thirds of shell fixed for instance by means of screws. The external surface of said left-hand spacer (19) can comprise surface treatments, as, by way of example only, chrome coating, able either to protect said surface, or to facilitate the sliding of the support of the milling drum on said surface, as previously explained. It will apparent to one skilled in the art that, in order to facilitate said sliding, the left-hand spacer (19) can also be made in stainless steel and include a protection tube (27), divided in sectors, made in long-wearing steel and applied on said left-hand spacer (19).

On the right side of the machine, the whole assembly consisting of the milling drum (3), the right-hand spacer (22), the reduction gear (13) is advantageously supported by means of the fixed support (14) on the right wall (29) of the miffing drum housing (7), but free to rotate on its axis with respect to said right wall (29) thanks to the presence of bearings (35). Advantageously with respect to prior art techniques, said support (14) is fixed and supports not only the reduction gear (13), but also the other rotating components, said fixing contributing to obtain a more stable design with a consequent further reduction of the wear of the components constituting the fixing system of the milling drum (3).

In order to facilitate the replacement of the milling drum (FIG. 6), the milling drum housing (7) has the right wall (29) hinged according to a vertical axis, while the support (14) is sliding in a bushing (30) to allow an easy opening of said right wall (29) simply moving back said support (14) with respect to the milling drum (3) and to the reduction gear (13) by means of means suitable for its withdrawal, as, for example, an extractor.

The dismounting operation of the milling drum (3) occurs according to the following steps:

1. with the drum lifted from the ground and free to rotate:
   a. removing some of the screws fixing the left flange (26) of the milling drum (3) to the ring (24), said removing leaving screwed only a number of screws able to ensure the support of said milling drum (3) by said ring (24), said removing happening on the lower part of the machine
   b. removing of some of the screws fixing the right flange (23) of the milling drum (3) to the left-hand support (14), said removing leaving screwed only a number of screws able to ensure the support of said milling drum (3) by said support (14), said removing happening on the lower part of the machine
2. with the milling drum held up by support means (eg.: a transpallet with a hollow seat for the drum)
   c. removing of the last screws fixing the right flange (23) of the milling drum (3)
   d. to the right-hand spacer (22), said removing happening from the bottom on the right side of the machine, and through a suitable opening on the upside of the right wall (29) of the milling drum housing (7)
   e. moving backward the support (14) with respect to the milling drum (3) and to the reduction gear (13) by means of means suitable for its moving backward, as, for example, an extractor
   f. opening the right wall (29) of the milling drum housing (7)
   g. removing the remaining screws fixing the left flange (26) of the milling drum (3) to the ring (24), said removing happening from the bottom on the left-hand side of the machine, and through a suitable opening on the upside of the left wall of the milling cutter case (7) extraction (FIG. 6) of the milling drum (3) through the opening of said right wall (29) by means of the use of the transpallet.

At the end of the operations a to g the left-hand spacer (19), the supporting ring (24), the reduction gear (13), the transmission shaft (18) and the right-hand spacer (22) advantageously remain engaged among them and sustained by the left wall of the milling drum housing (7).

The mounting operation of the milling drum (3) itself occurs in a particularly simple way, performing the same phases in the reverse order, preceded by the positioning phase of the system to support the milling drum present on the left-hand side of the same as previously described, if the milling drum (3) must be replaced with a milling drum having a different width.

The collecting belt (5) receives the milled material thanks to the loading action of the milling drum (3) when the drum operates on the maximum provided width. When the milling drum (3) works with reduced cutting widths, the milled material is only partially directly discharged onto the collecting belt (5) by the action of the milling drum (3). In this condition the milling drum housing (7) on the left side of the drum tends to be filled with the milled material, that is picked by the collecting belt (5) due to the overflow. As previously explained such portion of the milling drum housing (7) not occupied by the milling drums (3) with lower widths does not present any rotating part, the left-hand spacer (19) being static inside the mass of the milled material contained inside the milling drum housing (7), thus avoiding a harmful action of kneading of the milled bituminous material present in the milling drum housing (7) itself and reducing the friction and the consequent developed heat as well as the wearing of the components.

Figure 7:
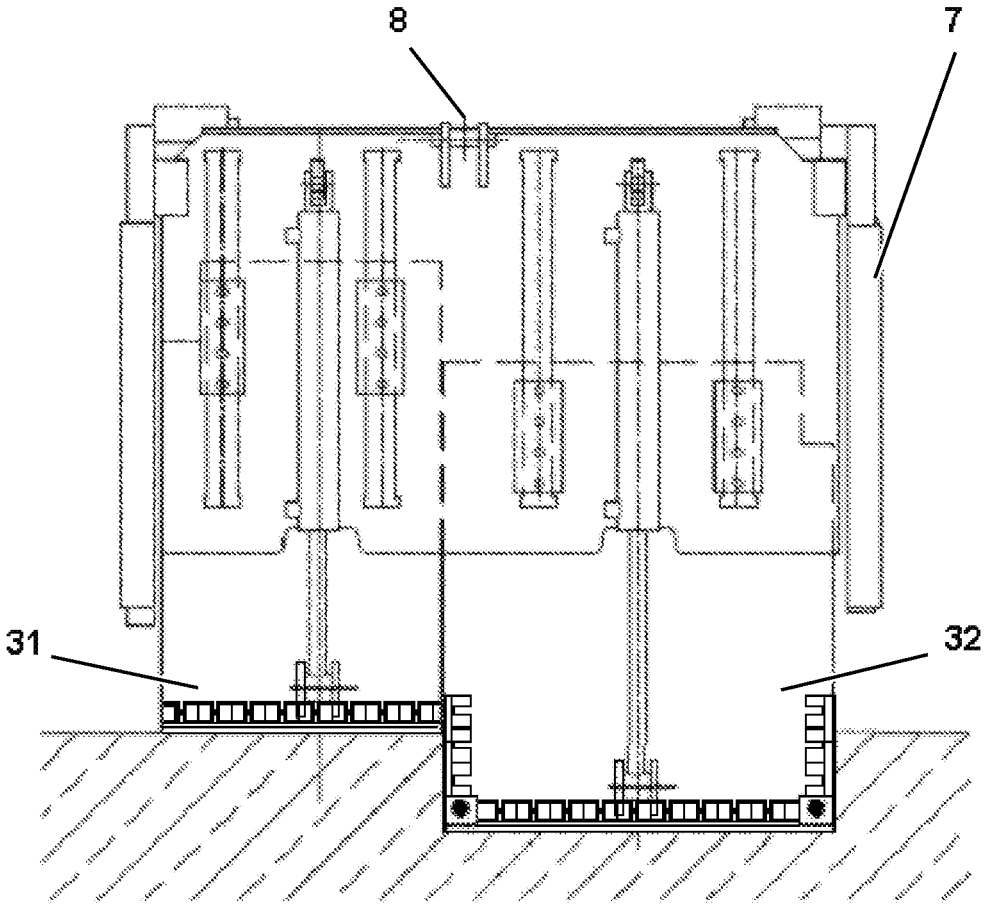
FIG. 7 represents a view from the rear side of the rear mouldboard closing the housing containing the milling drum.

The rear mouldboard (8) must settle (FIG. 7) to the various milling width, for which reason it is manufactured, according to prior art, in two or more sectors (31, 32). Said sectors are independently operated so that a part of them exactly enters inside the excavation made by the milling drum (3) in order to clean the milled surface and prevent the rearward exit of the milled material from the milling machine, while the remaining part(s) is(are) in contact with the road surface on the left-hand side of the excavation.

The description of this invention has been made with reference to the enclosed figures showing a preferred embodiment of the invention itself, but it is evident that many alterations, modifications and variations will be apparent to those skilled in the art in light of the foregoing description. Thus, it should be understood that the invention is not limited by the foregoing description, but embraces all such alterations, modifications and variations in accordance with the spirit and scope of the appended claims.

What is claimed is:

1. A self-propelled road milling machine including a milling drum housing mounted on the chassis of the machine, said milling drum housing including a side comprising a power take-off able to transmit the rotational motion from an engine, inside said milling drum housing being alternatively mountable a series of milling drums each of which being made of a single piece including cutting tools on its external surface, said milling machine comprising one milling drum of said series being mounted in an axially sliding way from the side opposed with respect to the side of said power take-off in order to allow the replacement of said milling drum, said milling drum comprising fastening elements radially protruding from an internal surface of the milling drum, the rotation of said milling drum being realized by means of a reduction gear, said reduction gear being mounted at the end of a hollow spacer placed between said reduction gear and said side including the power take-off, in said hollow spacer being present the transmission shaft transmitting the rotatory motion from said power take-off to said reduction gear, said reduction gear being supported on the side opposed with respect to the side of said power take-off by a support wherein said hollow spacer rigidly connects the wall of the milling drum housing corresponding to the side of said power take-off to a support flange of said reduction gear, said reduction gear being connected to a spacer on the side opposed with respect to the side of said power take-off and said spacer engaging with a rotatable flange of said reduction gear, said spacer being connected to said fastening elements of said milling drum and with said support on the wall of said milling drum housing opposed with respect to said power take-off side, said support including bearings, all being coordinated and structured in such a way that said support flange and said hollow spacer are static with respect to the rotary movement of said milling drum.

2. The self-propelled road milling machine according to claim 1 further comprising a milling drum support able to support said milling drum from the side of said power take-off, said milling drum support including a static part with respect to the rotary movement of said milling drum and a rotatable part integral with said milling drum once the drum is mounted, between said two parts being interposed a bearing, said static part being fixed on said hollow spacer.

3. The self-propelled road milling machine according to claim 2 wherein said static part of said milling drum support includes a ring fixed to said hollow spacer by a self-centering clamping.

4. The self-propelled road milling machine according to claim 2 wherein said miffing drum support is positionable in different points of the external surface of said hollow spacer, said milling drum support being slideable along said external surface of said hollow spacer, and including a cone clamping portion.

5. The self-propelled road milling machine according to claim 1 wherein said series of milling drums includes independent alternatively mountable milling drums made of a single piece having different overall width.

6. The self-propelled road milling machine according to claim 1 wherein said support includes bearings and support said reduction gear on the side opposite the side of said power take-off and is disposed in a bushing such that said support is slideable longitudinally with respect to the axis the of said milling drum.

7. The self-propelled road milling machine according to claim 1 wherein the wall of said drum milling housing on the opposed side with respect to the side of said power take-off is hinged according to a vertical axis.

8. The self-propelled road milling machine according to claim 1 further comprising segmented sheds able to be mounted on the radially external surface of the portion of said hollow spacer between the end of said milling drum corresponding to the side of said power take-off and between the wall of said milling drum housing on which said power take-off is present, the reciprocal connection of each segment with the radially adjacent segments forming a cylindrical cavity with a diameter corresponding to the major diameter of said hollow spacer.

9. The self-propelled road milling machine according to claim 8 wherein said segmented shells are couples of shells.

10. The self-propelled road milling machine according to claim 8 wherein said segmented shells are thirds of shell.

11. The self-propelled road milling machine according to claim 1 wherein said milling drum housing is provided with a vertically movable rear mouldboard, said mouldboard being provided with scraper tools in the lower edge.

12. The self-propelled road milling machine according to claim 11 wherein said rear mouldboard is hinged on an horizontal axis.

13. The self-propelled road milling machine according to claim 11 wherein said rear mouldboard includes means able to maintain said rear mouldboard in contact with the surface milled with forced or floating action.

14. The self-propelled road milling machine according to claim 1 wherein said milling drum housing is provided with side movable plates including means able to maintain said side movable plates in contact with the surface milled with forced or floating action.

15. The self-propelled road milling machine according to claim 1 further comprising at least one conveyor belt able to transport the material milled by said milling drum to suitable means for the collection of the milled material, said conveyor belt receiving the milled material flowing from an opening of said milling drum housing.

16. The self-propelled road milling machine according to claim 15, wherein said at least one conveyor belt comprises a collecting conveyor belt receiving the milled material flowing from said opening of said milling drum housing and a loading conveyor belt able to transport the milled material to said suitable means for the collection of the milled material.

17. The self-propelled road milling machine according to claim 16 wherein the part of said collecting belt close to said milling drum housing is supported by means maintained in contact with the surface to mill.

18. The self-propelled road milling machine according to claim 1 wherein the discharge of the milled material occurs frontally with respect to the advancing direction of the machine.

19. The self-propelled road milling machine according to claim 1 wherein the discharge of the milled material occurs rearwardly with respect to the advancing direction of the machine.

20. The self-propelled road milling machine according to claim 1 wherein said hollow spacer is made of stainless steel.

21. The self-propelled road milling machine according to claim 1 wherein the radially external surface of said hollow spacer is superficially treated to have a coating.

22. The self-propelled road milling machine according to claim 1 wherein the radially external surface of said hollow spacer is superficially treated to have a chrome coating.

* * * * *